United States Patent [19]

Conrad

[11] Patent Number: 4,759,778

[45] Date of Patent: Jul. 26, 1988

[54] AIR FILTER

[75] Inventor: Wayne E. Conrad, Brooklin, Canada

[73] Assignee: Tridon Environmental Inc., Burlington, Canada

[21] Appl. No.: 101,872

[22] Filed: Sep. 25, 1987

[30] Foreign Application Priority Data

Sep. 26, 1986 [CA] Canada ..... 519171

[51] Int. Cl.[4] ..... B03C 3/09; B03C 3/12; B03C 3/41

[52] U.S. Cl. ..... 55/131; 55/138; 55/146; 55/155

[58] Field of Search ..... 55/131, 132, 138, 146, 55/155

[56] References Cited

U.S. PATENT DOCUMENTS

| | | | |
|---|---|---|---|
| 2,571,079 | 10/1951 | Warburton | 55/131 |
| 2,579,445 | 12/1951 | Warburton | 55/155 X |
| 2,908,348 | 10/1959 | Rivers et al. | 55/132 |
| 2,917,130 | 12/1959 | Powers | 55/132 |
| 3,181,284 | 5/1965 | Copenhefer | 55/132 |
| 3,392,509 | 7/1968 | Pelosi, Jr. | 55/131 X |
| 3,509,696 | 5/1970 | Thompson | 55/131 |
| 3,763,633 | 10/1973 | Soltis | 55/131 X |
| 4,518,402 | 5/1985 | Dargel | 55/131 X |
| 4,549,887 | 10/1985 | Joannou | 55/131 |

*Primary Examiner*—Kathleen J. Prunner
*Attorney, Agent, or Firm*—Rogers & Scott

[57] ABSTRACT

The invention provides a filter structure for use with a high voltage power pack for filtering particulates from a stream of air passing through the filter structure. The structure includes a structural element for facing the stream of air and the back parallel and spaced from the front, the front and back defining a plurality of openings permitting a flow of air through the element. A planar insulating substrate is positioned adjacent the front of the structural element and has openings aligned with the openings in the structural element and a plurality of conductors are carried by the substrate about the openings for charging by the power pack. As a result, an electrostatic field is created across the openings orthogonally with respect to the flow of air between the conductors. A non-conductive filter element is positioned in contact with the conductors and between the conductors and the back of the structural element. The filter element defines tortuous paths for air flowing through the filter element whereby particulates in the air are ionized as they meet the electrostatic field and then impinge and are attached to the filter medium to clean the air.

13 Claims, 3 Drawing Sheets

AIR FILTER

This invention relates to an electrostatic filter structure for use in removing particulate matter entrained in an air stream, and more particularly to a filter structure for use in forced air heating systems of the type used domestically.

Electrostatic precipitators are well known for removing particulate matter from a stream of air. It has been common practice to pass the air through two stages, namely, a first or ionizing stage and secondly a collector stage. Typically, as air moves through the ionizing stage, it passes around one or more ionizing wires from which are spaced ground electrodes to provide an electrostatic field in which the particles in the air are ionized or charged electrically. In the second stage, which constitutes a plurality of alternately charged and grounded parallel collector plates, electric fields are created and the ionized particles are attracted to one or the other of the collector plates, depending upon the charge of the particle. The air then leaves the second stage in a cleaner and more purified state.

Examples of structures of this type can be found in U.S. Pat. Nos. 2,579,445 to Warburton; 2,847,082 to Roos, 2,822,058 to Roos et al; 2,908,347 to Roos; 3,073,094 to Landgraf et al; and 3,735,560 to Wellman. Structures such as these are impractical for use in many environments including domestic environments because they are too complicated and require expert servicing.

Attempts have been made to develop structures which can take the place of mechanical filters presently used in forced air heating systems and yet which use electrostatic principles to enhance the removal of particulates from the air. An early example of such a structure is U.S. Pat. No. 3,509,696 to Thompson which develops an electrostatic field in the direction of flow of the air through the filter. The field exists between a central high voltage source and front and back screens defining openings through which the air can pass. The electrostatic gradiant created in the direction of flow of the particulate material, while developing ionization of the particulates, is arranged inefficiently firstly because the particulates must enter the filter medium before they are affected by the electrostatic field, and secondly because the field is arranged inefficiently for the purposes of trapping ionized particles. The same comments can be made about a later structure shown in U.S. Pat. No. 3,763,633 to Soltis.

The most recent reference known to applicant is U.S. Pat. No. 4,007,027 to Sallee et al. This patent teaches a portable electrostatic air cleaning device having a minimal depthwise air-flow dimension which is particularly adapted to be substituted in an air conduit for a typical furnace or air conditioner filter. The structure uses ionizer wires and narrow collector plates alternately spaced widthwise of the air cleaner between a pre-filter screen and an after-filter screen. In effect, from the electrostatic standpoint, this amounts to an ionizer followed by a filter. Clearly, the effectiveness of such a structure is limited by the thickness dimension available if the structure is to replace conventional mechanical filters.

In summary, the prior art teaches structures which have disadvantages of complexity, cost and size making them unacceptable for use in systems such as domestic heating systems.

It is an object of the present invention to provide an electrostatic filter for use in removing particulates from a stream of air and particularly for use in forced air heating systems such as those used domestically in North America. In order to replace existing mechanical filters, it is desirable that the filter be of a thickness in the order of one inch and provide ionization of the particles prior to entry or as they enter a filter medium having as near as possible the full thickness of the filter in order to expedite removal of the particulates.

Accordingly, in one of its aspects, the invention provides a filter structure for use with a high voltage power pack for filtering particulates from a stream of air passing through the filter structure. The structure includes a structural element having a front for facing the stream of air and a back parallel and spaced from the front, the front and back defining a plurality of openings permitting a flow of air through the element. A planar insulating substrate is positioned adjacent the front of the structural element and has openings aligned with the openings in the structural element and a plurality of conductors are carried by the substrate about the openings for charging by the power pack. As a result, an electrostatic field is created across the openings orthogonally with respect to the flow of air between the conductors. A non-conductive filter element is positioned in contact with the conductors and between the conductors and the back of the structural element. The filter element defines tortuous paths for air flowing through the filter element whereby particulates in the air are ionized as they meet the electrostatic field and then impinge and are attached to the filter medium to clean the air.

This and other aspects of the invention will be better understood with reference to the drawings, in which.

Figure 1:
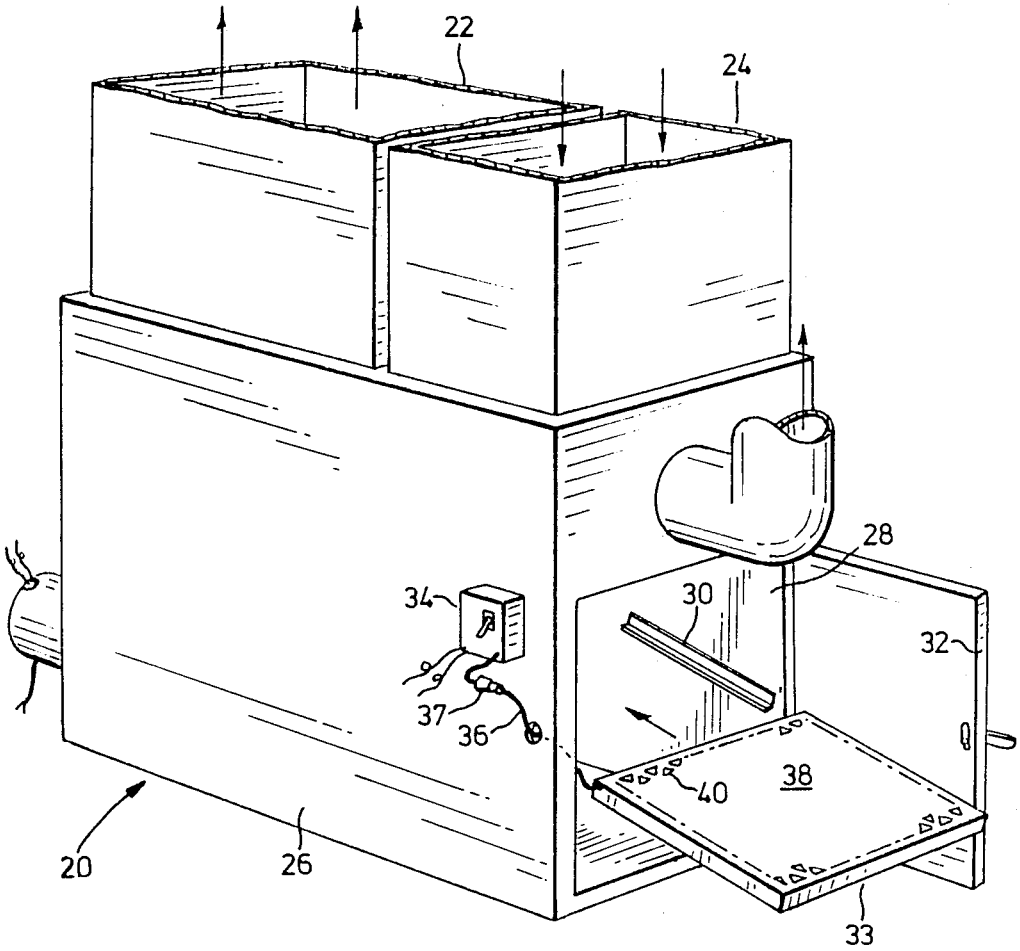
FIG. 1 is a diagrammatic perspective view of a typical forced air furnace used in domestic heating systems and including an electrostatic filter according to a preferred embodiment of the invention.

Reference is made first to FIG. 1 which illustrates generally an exemplary forced air heating furnace 20 such as those used domestically in North America. The furnace has a hot air plenum 22 and a return plenum 24 sitting on a main body 26. As usual, the body contains a heat exchanger and the air flow is directed through a chamber 28 having a pair of tracks 30 (one of which can be seen) on which a filter normally sits. The chamber is sealed by a door 32 and the filter is normally of a mechanical type having a depth of approximately 1 inch. As shown in FIG. 1, a preferred embodiment of the invention designated generally by the numeral 33 is an electrostatic filter associated with a power pack 34 mounted on the side of the main body and connected by cable 36 and connector 37. The cable passes through the side of the body and is sufficiently long to permit replacement of the filter which is proportioned to replace an existing mechanical filter and to sit on the tracks 30 in the same manner as the mechanical filter. Once in place, and energized by the power pack 34, the filter is capable of ionizing particulates in air returned through the plenum 24 and then trapping the ionized particulates in an electrostatic field formed in a mechanical filter to enhance the action of the mechanical filter. Details of this structure will be described with reference to subsequent drawings but it can be seen for the moment in FIG. 1 that a front 38 of the filter defines a plurality of triangular openings 40 arranged in rows and columns with minimal structure to maximize the area available for air to flow through the filter. A similar arrangement is made on the back of the filter (not shown in this view). Clearly, there is an optimum arrangement of openings to maximize the open area relative to the total area of the front. In the preferred embodiment, the openings are triangular but other arrangements could also be used.

Figure 2:
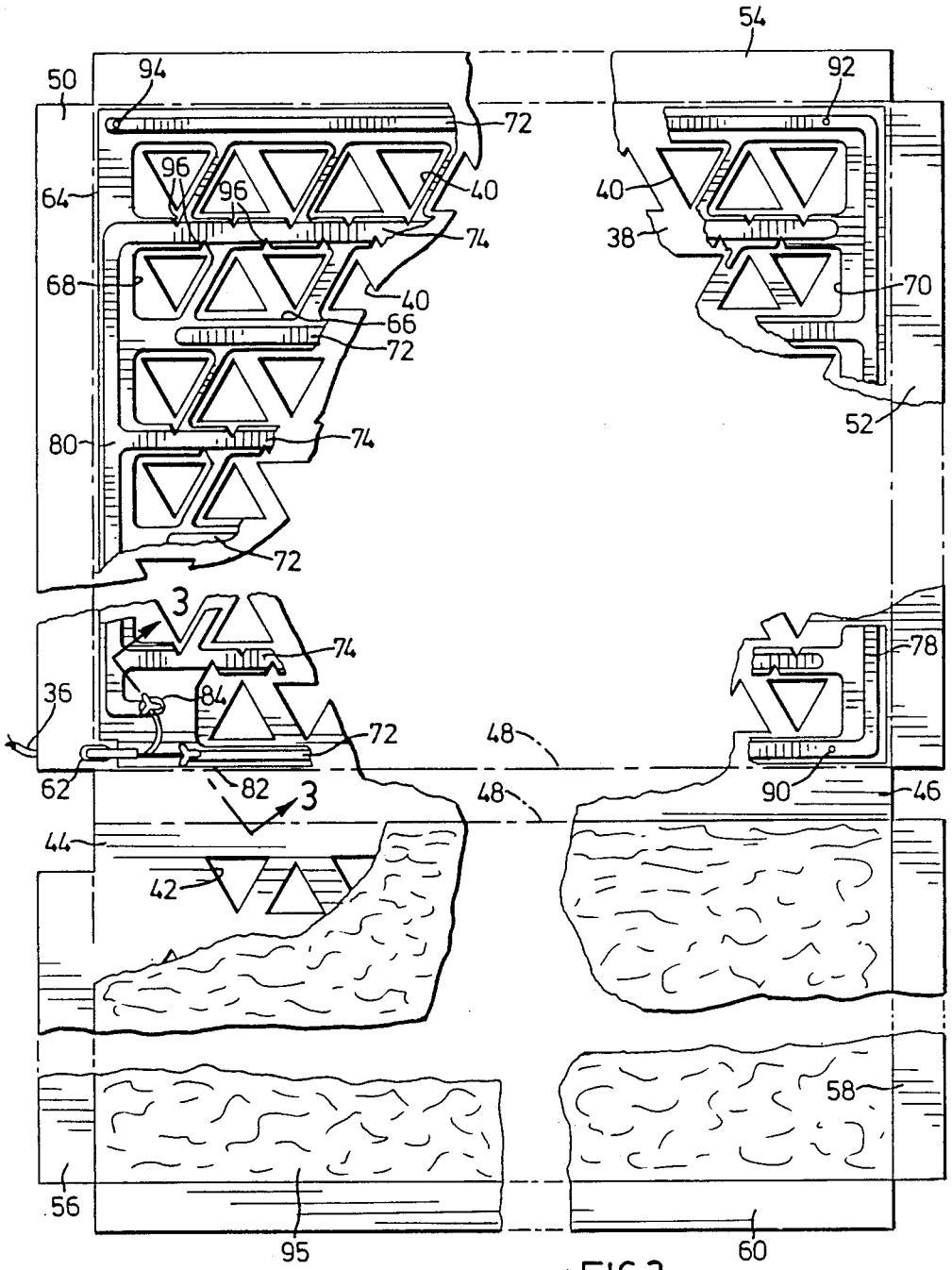
FIG. 2 is a top view of the filter shown during assembly to illustrate the internal parts of the filter.

Reference is now made to FIG. 2 to describe the structure in more detail. This view illustrates the electrostatic filter just before it is completed. The view is drawn to show the internal components which are supported on a paper blank which includes the front 38, back 44, and a spine 46 separated from the front and back by respective ones of a pair of weakness lines 48 defined to permit folding. These lines extend in parallel and border the rectangular and similar front and back 38, 44. The front 38 is bordered by a pair of full length side flaps 50, 52 of similar width to the spine 46, and opposite the spine 46 is an end flap 54 complementing the shape of the spine. The flaps 50, 52 and 54 cooperate with respective flaps 56, 58 and 60 bordering the back 44. The flaps are full length with respect to the sides of the front and back with the exception of the flap 56 which falls short of the nearer fold line 48 in order to provide space to accommodate cable 36 where it passes through an opening 62 between the flap 50 and the front 38. All of the flaps are connected by weakness or fold lines to the respective front and back, and after folding about the lines 48, the adjacent flaps are glued to one another to form the boundary or edge structure of the filter 33.

As seen in FIG. 2, the front 38 defines the triangular openings 40 arranged in rows with adjaceant triangles inverted adjacent to one another. Each triangle also forms part of a column of similar triangles. The column adjacent flap 50 is short one triangle with respect to the other columns to form an area where the cable 36 can be connected as will be described. Also, the back 44 includes triangular openings 42 of similar shape and location to the triangular openings 40 so that after assembly each of the openings 40 is aligned with an opening 42 in the same orientation.

The blank is preferably of a clay coated cardboard which is conductive at the voltages used and is part of the ground of the electrostatic filter as will be described. The blank, after assembly, is referred to as the structural element of the filter.

The front 38 supports an insulating substrate 64 which is preferably of 15 mil styrene and proportioned to just fit within the boundaries of the front 38. The substrate also defines openings such as opening 66 which each accommodate two of the triangular openings 40. Other openings such as opening 68 at one end of each row of openings accommodates one of the openings 68 in the substrate while at the other end of the rows there are openings 70 each accommodating two of the triangular openings. Each of the rows of openings in the substrate is bordered at one of its sides by a ground conductor 72 and at its other side by a charge conductor 74 which in use is maintained at about minus 8000 volts with respect to the conductors 72 by the power pack 34 (FIG. 1).

The pairs of ground conductors 72 are connected at their ends to a conductor 78 running parallel to the columns rather than to the rows, and similarly, the charge conductors 74 are connected to a conductor 80 running parallel to the conductor 78 but at the other side of the substrate. All of these conductors are inked on to the substrate using any suitable conductive ink such as that sold under the trade name ACHESON ELECTRODAG 423ss Graphite ink.

The ground conductors are arranged with the charge conductors in an interlocking finger pattern such that when considering columns of openings, each opening is bordered by one ground conductor and one charge conductor. The ground conductors originate from a termination 82 at the bottom left hand corner of the substrate as drawn, and the charge conductors from a termination 84 both of which are connected to corresponding conductors in the cable 36.

The terminations 82 and 84 are in the form of rivets holding ends of the cable 36 in contact with the respective conductors 72, 74. As seen in sectional view FIG. 3, the termination 84 consists of a rivet 85 penetrating the substrate 64 and end of conductor 80 to hold down an end fitting 86 in contact with the conductor 80. The front 38 of the structural element of the filter provides a clearance opening 88 to avoid contact with this charged rivet. In contrast, termination 82 is of similar construction but the rivet head is in contact with the front 38 so that the ground connection is continuous through the rivet between conductor 72 and the front 38.

Figure 3:
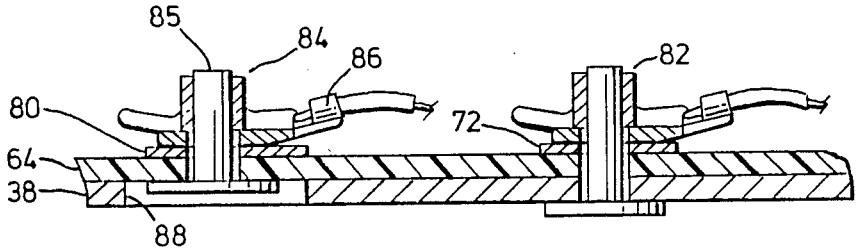
FIG. 3 (drawn adjacent FIG. 1) is a sectional view drawn to a larger scale on line 3—3 of FIG. 2.

The substrate 64 is also held to the front 38 by rivets 90, 92, and 94 positioned adjacent the corners of the front and penetrating the ground conductor and made to be in contact with the front 38 in the manner demonstrated with respect to the termination 82 in FIG. 3. As a result, the clay coated blank used to form the structural element is maintained at ground potential in common with the conductors 72 and connecting conductor 78.

The charge conductors 74 include a series of notches 96 forming discontinuities in the edges of these conductors. The notches are formed both in the conductors and in the substrate as will be described with reference to FIG. 4. The filter also includes a filter element 95 of a non conductive material, preferably a polyester foam mat known as LFR Blue Class II polyester filter medium of 5 oz. density.

Figure 4:
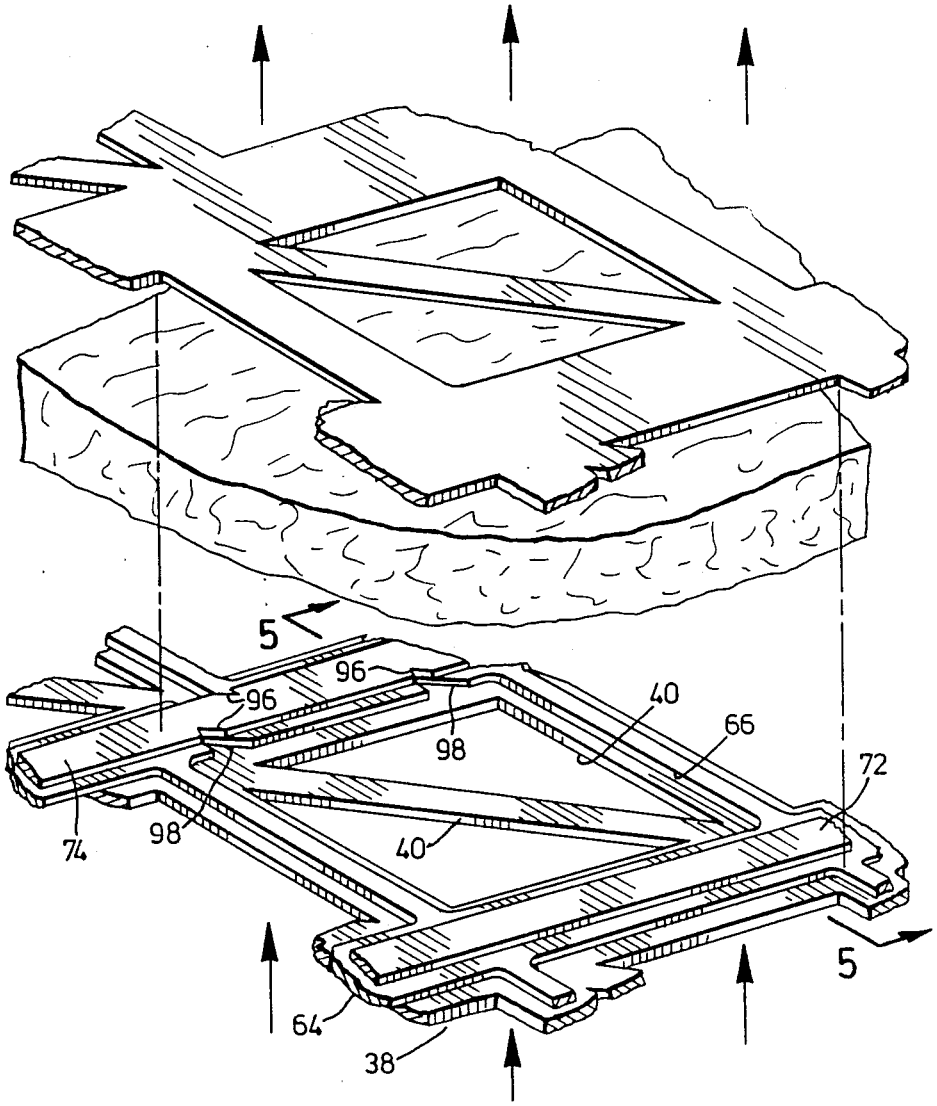
FIG. 4 is an exploded perspective view of a portion of the filter drawn to a larger scale to better illustrate detail of the parts.

Reference is next made to enlarged view FIG. 4. This view is not drawn to scale and is designed to illustrate the layers of material and how they inter-relate. Conductors 74 and 72 border a pair of triangular openings 40 in the front 38 and these openings are aligned with a clearance opening 66 in the substrate 64. The ink conductors 72, 74 are essentially part of the substrate and the conductor 74 includes notches 96 in its side edges. These notches are die cut by tools which also form aligned notches 98 in the substrate. The discontinuities in the edge structure so formed in the conductor 74 create stress points when a charge is applied to the conductor 74 with reference to the ground conductor 72. An electrostatic field is built up between the conductors extending transversely or orthogonally with respect to the direction of flow of air through the filter as indicated by the arrows in FIG. 4. Because the field is created immediately adjacent the front of the electrostatic filter, particles entering the filter will be subjected to the field prior to meeting the filter element 95 which fills the space between the front and back of the filter in contact with the substrate and conductors.

Figure 5:
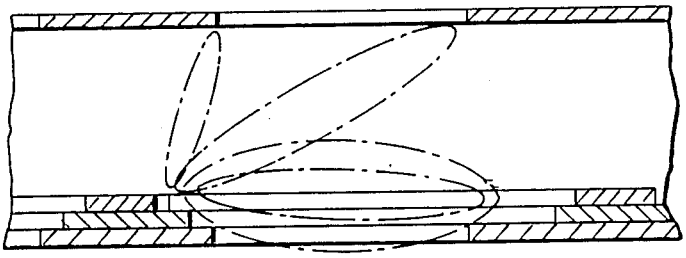
FIG. 5 is a sectional view on line 5—5 of FIG. 4.

The board used to make the blank which forms a structural element of the filter is conductive and at ground potential so that the electrostatic field is three dimensional, extending between the charge conductor 74 and points of ground including conductor 72 and the structural element. An indication of the field is given in FIG. 5. This drawing is not intended to illustrate the field densities but simply the general position of the field because of the difficulty of demonstrating a three-dimensional effect. It will be evident however, that by aligning the conductors 74 and 72 in a common plane, there will be a portion of the overall electrostatic field created in a plane at right angles to the general flow of air so that particulate material in the air must pass through the field in order to meet the mechanical filter. During this passage the particulates will be ionized and this has been demonstrated by the fact that slow motion photography shows that the particulates under the influence of the charge tend to break up before entering the actual filter medium. This demonstration that the particulates are charged is further accentuated by the pattern of collection which has been shown to be towards the grounded portions of the filter.

It will also be appreciated that the overall field created (and demonstrated diagrammatically in FIG. 5) will be non-uniform as seen by particulate material entering the filter. As a result there is a random deposition which enhances the action of the filter and allows the filter to remain functional for a longer period of time. The overall effect of the total field is to first ionize and then trap particulate material due to the electrostatic effects of the filter. This is enhanced by the filter medium which exhibits tortuous paths for the air. As a result, as the ionized particles are directed towards ground, they will tend to be entrapped in their towards ground mechanically as well as electrostatically.

It has been found that the arrangement of the electrostatic filter structure is such that it is acceptable as a replacement for mechanical filters of similar thickness and, because of the inexpensive structure, they are acceptable as replacements for use in environments where enhanced filtration is desirable. For instance, in homes where smoke, and pollen and other pollutants must be removed for health reasons, then this filter has great advantages over mechanical filters and over prior art filters.

It will be clear that many variations can be made to the structure within the ambit of the invention, and all of these variations are within the scope of the claims.

We claim:

1. A filter structure for use with a high voltage power pack for filtering particulates from a stream of air passing through the filter structure, the filter structure comprising:

a structural element having a front for facing the stream of air and a back parallel with and spaced from the front, the front and back defining a plurality of openings permitting flow of air through the element;

a planar insulating substrate adjacent the front of the structural element and having openings aligned with the openings in the structural element;

a plurality of conductors carried by the substrate about the openings such that an electrostatic field is created across the openings orthogonally with respect to the flow of air between the conductors when the conductors are charged by the power pack;

a non-conductive filter element in contact with the conductors and extending between the conductors and the back of the structural element and defining tortuous paths for air flowing through the structure whereby said particulates in the air are ionized as they meet the electrostatic field and impinge and are attached to the filter element to clean the air.

2. A filter structure as claimed in claim 1 in which some of the conductors are maintained at ground potential and coupled electrically to the structural element to maintain this element at ground potential to enhance the electrostatic field.

3. A filter structure as claimed in claim 1 in which the conductors are inked on to the substrate in an interlocking finger pattern about the openings in the substrate.

4. A filter structure as claimed in claim 1 in which the structural element is of clay coated card.

5. A filter structure as claimed in claim 1 in which the substrate is of styrene having a thickness of about 15 mils.

6. A filter structure as claimed in claim 1 in which the filter element is of foamed polyester.

7. A filter structure as claimed in claim 1 in which the openings in the said front and back are triangular and arranged in rows and columns with adjacent openings in each row being inverted with respect to one another.

8. A filter structure as claimed in claim 1 in which some of the conductors are charged and have discontinuities creating corner structures to better define the electrostatic field pattern.

9. A filter as claimed in claim 8 in which the discontinuities are V-shaped notches formed in the conductors.

10. A filter structure for use with a high voltage power pack for filtering particulates from a stream of air passing through the filter structure, the filter structure comprising:

a structural element having a front for facing the stream of air and a back parallel with and spaced from the front, the front and back defining a plurality of openings permitting flow of air through the element and arranged in rows;

a planar insulating substrate adjacent the front of the structural element and having rows of openings aligned with the openings in the structural element;

ground and charge conductors lying in a common plane and carried by the substrate, the conductors being arranged alternately between said rows of openings in an interlocking finger pattern for charging by the power pack such that an electrostatic field is created across the openings orthogonally with respect to the flow of air between the conductors and through the openings;

a non-conductive filter element in contact with the conductors and extending between the conductors and the back of the structural element and defining tortuous paths for air flowing through the structure whereby said particulates in the air are ionized as they meet the electrostatic field and impinge and are attached to the filter element to clean the air.

11. A filter structure as claimed in claim 10 in which the ground conductors are coupled electrically to the structural element to maintain this element at ground potential to enhance the electrostatic field.

12. A filter structure as claimed in claim 10 in which the charge conductors have discontinuities creating corner structures to better define the electrostatic field pattern.

13. A filter as claimed in claim 12 in which the discontinuities are V-shaped notches formed in the conductors where they face the grounded conductors.

* * * * *